US008801475B2

(12) United States Patent
Maninchedda

(10) Patent No.: US 8,801,475 B2
(45) Date of Patent: Aug. 12, 2014

(54) MANIFOLD

(71) Applicant: Friedrich Goehringer Elektrotechnik GmbH, Triberg, DE (US)

(72) Inventor: Patrice Maninchedda, Libercourt (FR)

(73) Assignee: Friedrich Goehringer Elektrotechnik GmbH, Triberg (DE)

( * ) Notice: Subject to any disclaimer, the term of this patent is extended or adjusted under 35 U.S.C. 154(b) by 70 days.

(21) Appl. No.: 13/628,496

(22) Filed: Sep. 27, 2012

(65) Prior Publication Data

US 2014/0080365 A1 Mar. 20, 2014

(30) Foreign Application Priority Data

Sep. 14, 2012 (DE) ..... 10 2012 108 616

(51) Int. Cl.
*H01R 4/36* (2006.01)

(52) U.S. Cl.
USPC ..... 439/814

(58) Field of Classification Search
USPC ..... 439/810–814, 798, 721, 723
See application file for complete search history.

(56) References Cited

U.S. PATENT DOCUMENTS

| | | | | |
|---|---|---|---|---|
| 3,133,779 | A * | 5/1964 | Stanback | 439/798 |
| 3,577,114 | A * | 5/1971 | Hawkins | 439/277 |
| 3,794,963 | A * | 2/1974 | Cooper, Jr. | 439/798 |
| 4,214,806 | A * | 7/1980 | Kraft | 439/620.21 |
| 4,382,651 | A * | 5/1983 | Klosin et al. | 439/359 |
| 4,456,326 | A * | 6/1984 | Sauber | 439/540.1 |
| 4,513,169 | A * | 4/1985 | McGrane | 174/138 F |
| 4,547,627 | A * | 10/1985 | McGrane | 174/138 F |
| 5,199,905 | A * | 4/1993 | Fillinger | 439/723 |
| 5,727,314 | A * | 3/1998 | Ashcraft | 29/884 |
| 5,848,913 | A * | 12/1998 | Ashcraft | 439/521 |
| 5,931,708 | A * | 8/1999 | Annas et al. | 439/798 |
| 6,325,675 | B1 * | 12/2001 | Harmeyer | 439/709 |
| 6,368,162 | B1 * | 4/2002 | Reetz et al. | 439/723 |
| 6,579,131 | B1 * | 6/2003 | Ashcraft et al. | 439/798 |
| 6,769,941 | B2 * | 8/2004 | Norden | 439/798 |
| 6,854,996 | B2 * | 2/2005 | Yaworski et al. | 439/276 |
| 6,971,926 | B1 * | 12/2005 | Walton | 439/798 |
| 7,014,514 | B2 * | 3/2006 | Zahnen | 439/798 |
| 7,311,564 | B2 * | 12/2007 | Zahnen | 439/798 |

(Continued)

FOREIGN PATENT DOCUMENTS

| | | |
|---|---|---|
| CA | 2531931 | 6/2007 |
| EP | 1930986 A1 | 6/2008 |

(Continued)

OTHER PUBLICATIONS

"Search Report (German)", European Search Report for EP Application No. 13171560.9, (Nov. 18, 2013), 1-6.

*Primary Examiner* — Ross Gushi
(74) *Attorney, Agent, or Firm* — TechLaw LLP

(57) ABSTRACT

The invention relates to a distribution block (10, 10', 10'', 10''') having an approximately cuboid basic body (12) with four longitudinal sides (12*a*, 12*b*, 12*c*, 12*d*) and two end sides (12*e*, 12*f*), the basic body (12) being produced from a conductive material and a plurality of connector elements (14, 14') being arranged on at least one of the longitudinal sides (12*b*), a blind opening (16*a*, 16*b*) being arranged in at least one of the end faces (12*e*, 12*f*) of the basic body (12), and there being fastening means for fastening an electrically conducting element which is introduced into the blind opening.

16 Claims, 22 Drawing Sheets

(56) References Cited

U.S. PATENT DOCUMENTS

Figure 1:
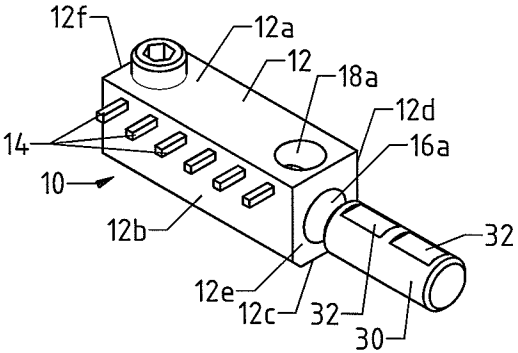

| | | | | |
|---|---|---|---|---|
| 7,416,454 | B2 * | 8/2008 | Tamm et al. | 439/798 |
| 7,473,147 | B2 * | 1/2009 | Zahnen | 439/798 |
| 7,481,684 | B2 * | 1/2009 | Bundren | 439/798 |
| 7,537,467 | B1 * | 5/2009 | Gretz | 439/108 |
| 7,591,656 | B1 * | 9/2009 | Gretz | 439/108 |
| 7,785,158 | B1 * | 8/2010 | McCoy et al. | 439/798 |
| 7,931,508 | B1 * | 4/2011 | Carr | 439/798 |
| 7,942,679 | B1 * | 5/2011 | Gretz | 439/108 |
| 7,988,503 | B2 * | 8/2011 | King et al. | 439/778 |
| 8,277,263 | B1 * | 10/2012 | Smith | 439/779 |
| 8,425,264 | B2 * | 4/2013 | Michell et al. | 439/789 |
| 8,480,414 | B2 * | 7/2013 | Carnevale et al. | 439/97 |
| 8,480,442 | B2 * | 7/2013 | Pini | 439/814 |
| 8,485,852 | B2 * | 7/2013 | Wu | 439/814 |
| 2004/0067697 | A1 * | 4/2004 | Zahnen | 439/798 |
| 2004/0087220 | A1 * | 5/2004 | Norden | 439/798 |
| 2004/0152370 | A1 * | 8/2004 | Ducrot | 439/814 |
| 2005/0009413 | A1 * | 1/2005 | Ferretti et al. | 439/798 |
| 2005/0202732 | A1 * | 9/2005 | Rizzo et al. | 439/810 |
| 2005/0287876 | A1 * | 12/2005 | Drane et al. | 439/798 |
| 2006/0063437 | A1 * | 3/2006 | Hay | 439/810 |
| 2006/0105637 | A1 | 5/2006 | Chiang | |
| 2007/0026745 | A1 * | 2/2007 | Ferretti | 439/814 |
| 2007/0167087 | A1 * | 7/2007 | Tamm et al. | 439/798 |
| 2007/0207682 | A1 * | 9/2007 | Zahnen | 439/798 |
| 2007/0249239 | A1 * | 10/2007 | Tamm et al. | 439/798 |
| 2008/0076306 | A1 * | 3/2008 | Zahnen | 439/798 |
| 2008/0146089 | A1 * | 6/2008 | Bundren | 439/798 |
| 2008/0268721 | A1 * | 10/2008 | Waltz | 439/793 |
| 2009/0035987 | A1 | 2/2009 | Daly | |
| 2009/0163087 | A1 * | 6/2009 | Sweeney et al. | 439/798 |
| 2011/0237140 | A1 * | 9/2011 | Cerasale | 439/797 |
| 2012/0115373 | A1 * | 5/2012 | Pini | 439/814 |

FOREIGN PATENT DOCUMENTS

| | | |
|---|---|---|
| FR | 2757688 | 6/1998 |
| GB | 830765 | 3/1960 |
| WO | WO-0205389 | 1/2002 |

* cited by examiner

MANIFOLD

The invention relates to a distribution block, by means of which electric current can be distributed to different connector components.

Distribution blocks are known having a basic body and connector elements which are arranged thereon, which distribution blocks are die-cut out of a plate, it possibly being necessary for the connector elements to be subsequently subjected to a post-treatment, in particular to be bent.

EP 1 930 986 A1 discloses a distribution block having a basic body and connector elements which are arranged thereon, which distribution block is cast integrally in the form of a plate having connector elements which are arranged thereon and are subsequently possibly likewise bent away in a post-treatment step.

It is a disadvantage in the case of the known distribution blocks that they are hardly flexibly usable and are not very suitable, in particular, for varying, in particular high, currents.

It is the object of the invention to provide a distribution block which affords a wide variety of possible uses.

The object of the invention is achieved by a distribution block having the features of patent claim 1.

Advantageous refinements and developments of the invention are specified in the dependent claims.

The distribution block according to the invention has an, in particular, cuboid basic body with four longitudinal sides and two end sides, the basic body being produced from a conductive material and a plurality of connector elements being arranged on at least one of the longitudinal sides, a blind opening being arranged in at least one of the end faces of the basic body, and there being fastening means for fastening an electrically conducting element which is introduced into the blind opening. Here, electrically conducting elements are to be considered to be not only electrical conductors such as cables, but rather also, for example, connecting elements, by means of which two or more distribution blocks according to the invention can be connected to one another. Therefore, via the blind opening, in particular, a connection of, for example, a supply cable or else the possibility to connect two valve blocks according to the invention in a structurally simple way is made possible. In particular, the use of the blind opening provides the option of producing both the feeding device and the outputs from one material, in particular in one piece.

According to one preferred embodiment of the invention, the fastening means are configured as a clamping screw which can be screwed into an internal thread which is arranged in a through hole to the blind opening, which through hole is arranged so as to start from one of the longitudinal sides of the basic body. An embodiment of this type of the fastening means can be produced particularly simply and inexpensively.

The fastening means are advantageously configured as at least one latching element which is arranged in the blind opening. An embodiment of this type of the fastening means is particularly space-saving.

The connector elements are preferably arranged with in each case one of the end faces of the connector elements integrally on one longitudinal side of the basic body, which results in a sufficient length of the connector elements for simple connection to the connector elements.

According to one preferred embodiment of the invention, the connector elements are of cuboid configuration at least in sections with four longitudinal sides and two end sides, and both the height of the end side of the basic body is greater than the height of the end side of the connector element and the width of the end side of the basic body is greater than the width of the end side of the connector element. This results in a distribution block with a basic body which has a substantially greater cross-sectional area than the connector elements, with the result that great currents can also be distributed without problems by way of the distribution block.

According to one preferred embodiment of the invention, the area of the end side of the basic body is greater by a factor of at least 10 than the area of the end side of one of the connector elements, which aids the distribution of high currents.

One preferred embodiment of the invention provides that the distribution block is arranged in an insulating housing, in order to avoid a user coming into contact with current-conducting elements.

According to one particularly preferred embodiment of the invention, the housing is configured in two pieces with a bottom part and a cover part, slots for introducing the connector elements being arranged in the bottom part so as to start from an outer edge. The two-piece refinement makes simple insertion of the distribution block into the housing possible. Reliable insulation with simple introduction into the housing part is made possible by the slots in one of the housing parts.

Openings which are aligned with the existing blind openings are advantageously arranged in the bottom part and/or arranged in the cover part of the openings which are aligned with the existing through holes, in order to also make introduction of the supply cables and fixing of the supply cables possible in an insulated distribution block.

One advantageous embodiment of the invention provides that the distribution block is produced from aluminum, brass or copper, since said materials are simple to process and have high conductivity.

In one embodiment of the invention, in order to improve the corrosion resistance, the distribution block has a coating which comprises tin, zinc and/or nickel.

According to one particularly preferred embodiment of the invention, the distribution block is milled, die-cut, injection-molded or cast, as a result of which single-piece production of the distribution block is made possible in a simple way, the distribution block being particularly preferably cast, in order to make an inexpensive manufacturing process possible which requires scarcely any post-treatment.

The end sides of the basic body and/or the end sides of the connector elements are advantageously approximately square, which results in as great a cross-sectional area as possible with a compact construction, which cross-sectional area aids the distribution even of high currents.

A distribution block arrangement according to the invention has a first distribution block according to the invention and a second distribution block according to the invention which are either aligned with respect to one another in the longitudinal direction or are arranged so as to be parallel to one another, which results in a wide variety of possibilities to combine the distribution blocks according to the invention, which make flexible provision of a distribution block arrangement possible. In a simple way, the distribution blocks which are arranged so as to be aligned with respect to one another in the longitudinal direction make the provision of a distribution block arrangement with any desired number of connector elements possible. The parallel arrangement of two distribution blocks makes either the distribution of two different currents or the provision of a greater cross section for distributing higher currents possible.

The connection of the two distribution blocks, in the case of an arrangement so as to be aligned with respect to one another in the longitudinal direction, preferably takes place by means of a longitudinal connector which is inserted into the blind openings which are arranged in end sides which face one another, and the connection of the two distribution blocks, in the case of an arrangement so as to be parallel to one another, preferably takes place by means of a U-shaped transverse connector which is inserted into the blind openings which are arranged in the end sides which lie in one plane. A connection of this type can be realized inexpensively without great complexity.

In one advantageous embodiment of the invention, the transverse connector has at least one, preferably two, blind openings, there being fastening means for fastening an electrically conducting element which is introduced into the blind opening. As a result, the flexibility of the connecting arrangement is increased further.

The first and the second distribution blocks are preferably arranged in a common insulating housing, an insulating dividing wall preferably being arranged between the two distribution blocks if insulation of the two distribution blocks with respect to one another is desired.

Figure 2:
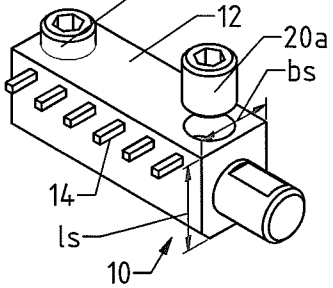
Figure 3:
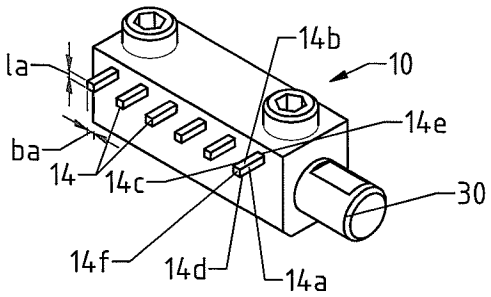
Figure 4:
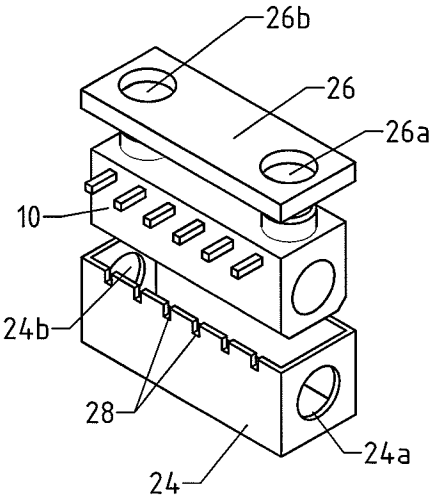
Figure 5:
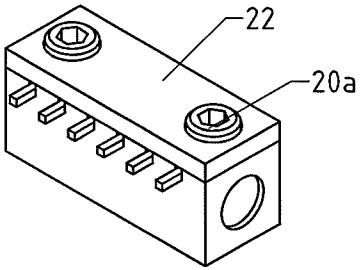
Figure 6:
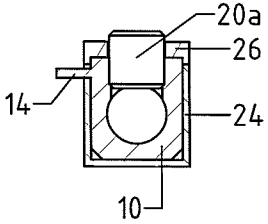
Figure 7:
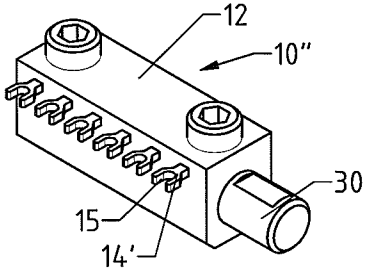
Figure 8:
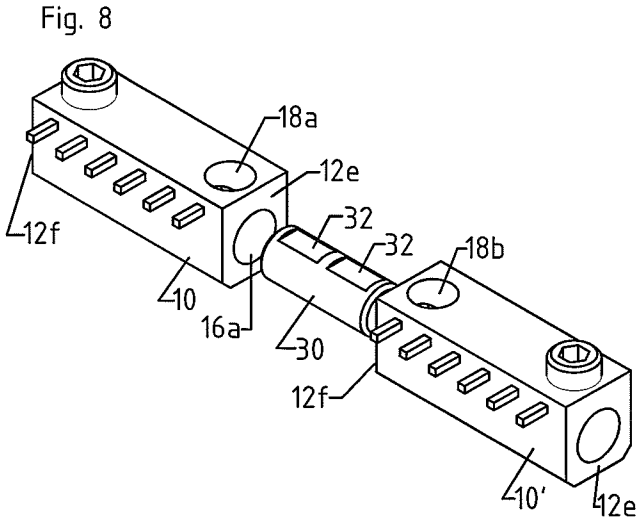
Figure 9:
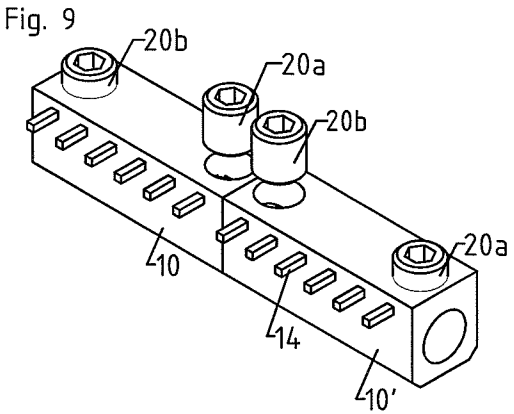
Figure 10:
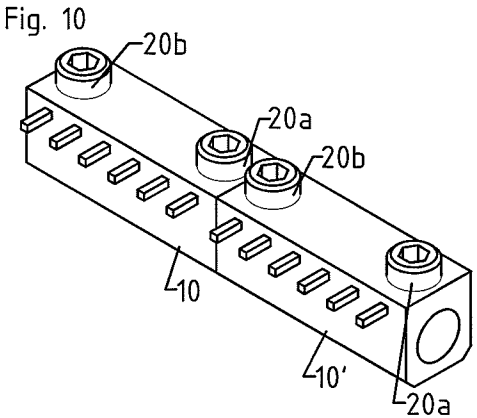
Figure 11:
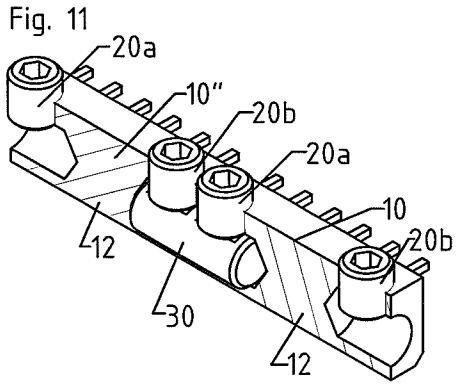
Figure 12:
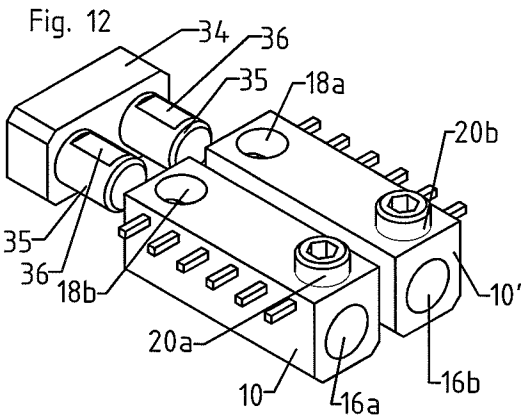
Figure 13:
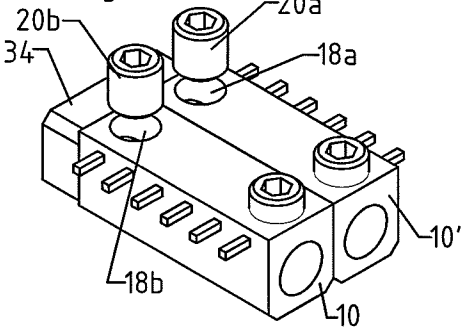
Figure 14:
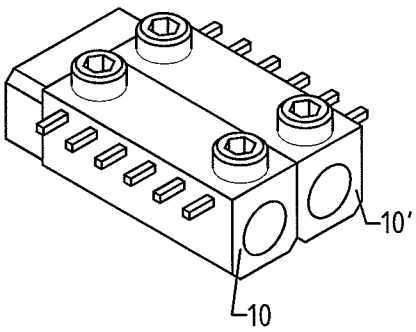
Figure 15:
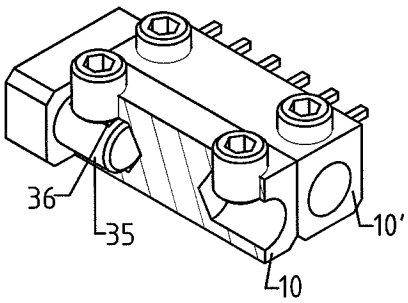
Figure 16:
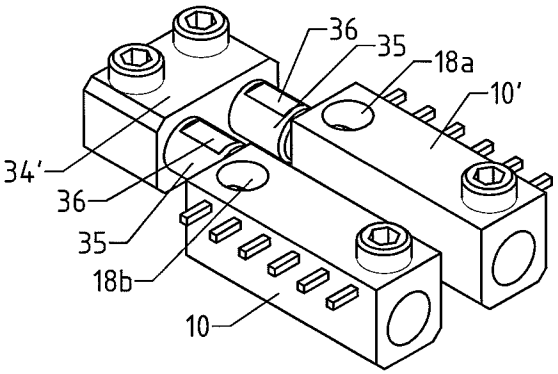
Figure 17:
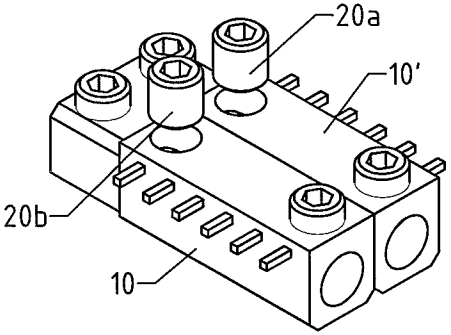
Figure 18:
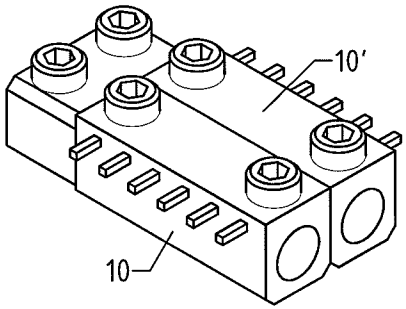
Figure 19:
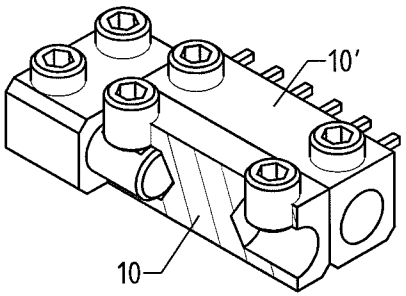
Figure 20:
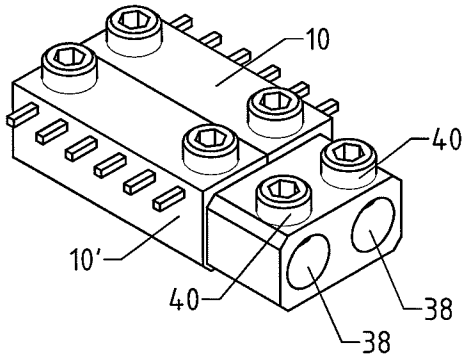
Figure 21:
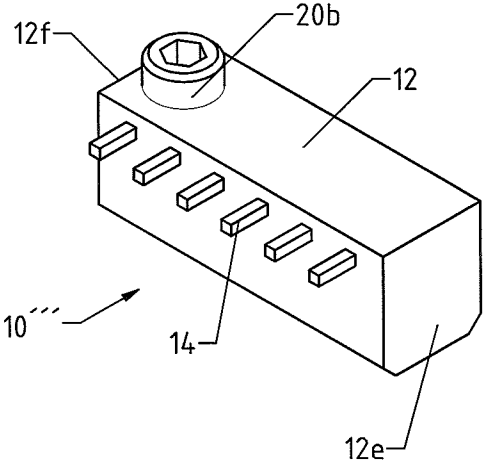
Figure 22:
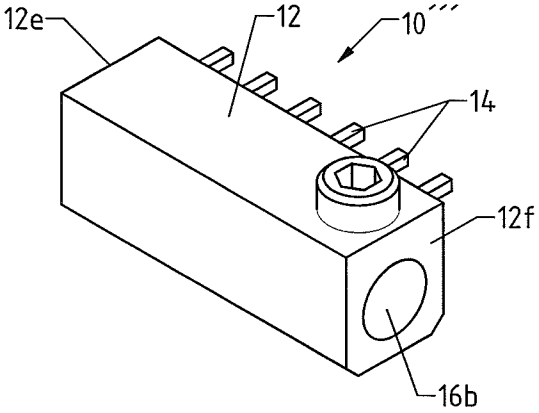

The invention will be explained in detail using the following figures, in which:

FIG. 1 shows a perspective view of one exemplary embodiment of a distribution block according to the invention and of a longitudinal connector, FIG. 2 shows the distribution block according to FIG. 1 with an inserted longitudinal connector, FIG. 3 shows the distribution block according to FIG. 1 with a longitudinal connector which is fixed by means of a clamping screw, FIG. 4 shows the distribution block according to FIG. 1 with an insulating housing in an exploded illustration, FIG. 5 shows the distribution block according to FIG. 4 in the assembled state, FIG. 6 shows a cross section through the distribution block according to FIG. 5, FIG. 7 shows a perspective view of a further exemplary embodiment of a distribution block according to the invention with an inserted longitudinal connector, FIG. 8 shows a perspective view of the components of a distribution block arrangement with two distribution blocks according to FIG. 1 and a longitudinal connector, FIG. 9 shows the distribution block arrangement according to FIG. 8 in the state of the two distribution blocks in which they are placed against one another, FIG. 10 shows the distribution block arrangement according to FIG. 9 with clamping screws which are screwed in, FIG. 11 shows a partially sectioned view of the distribution block arrangement according to FIG. 10, FIG. 12 shows a perspective view of the components of a distribution block arrangement with two distribution blocks according to FIG. 1 and a transverse connector, FIG. 13 shows the distribution block arrangement according to FIG. 12 in the state of the two distribution blocks in which they are placed against one another, with a transverse connector which is pushed in, FIG. 14 shows the distribution block arrangement according to FIG. 13 with clamping screws which are screwed in, FIG. 15 shows a partially sectioned view of the distribution block arrangement according to FIG. 14, FIG. 16 shows a perspective view of the components of a distribution block arrangement with two distribution blocks according to FIG. 1 and an alternative embodiment of a transverse connector, FIG. 17 shows the distribution block arrangement according to FIG. 16 in the state of the two distribution blocks in which they are placed against one another, with a transverse connector which is pushed in, FIG. 18 shows the distribution block arrangement according to FIG. 17 with clamping screws which are screwed in, FIG. 19 shows a partially sectioned view of the distribution block arrangement according to FIG. 18, FIG. 20 shows a further perspective view of the distribution block arrangement according to FIG. 18, FIG. 21 shows a perspective view of a further exemplary embodiment of a distribution block according to the invention, and FIG. 22 shows a further perspective view of the exemplary embodiment of a distribution block according to the invention according to FIG. 21.

In FIGS. 1 to 22, identical designations denote identical parts. For improved clarity, not all the designations are shown in all the figures.

FIGS. 1 to 3 show a first exemplary embodiment of a distribution block 10 which has a basic body 12 with four longitudinal sides 12*a*, 12*b*, 12*c*, 12*d* and two end sides 12*e*, 12*f* which lie opposite one another. On the basic body 12, a plurality of connector elements 14 are arranged on the longitudinal side 12*b* which are spaced apart from one another in the longitudinal direction and are of cuboid configuration at least in sections, over the entire longitudinal direction in this exemplary embodiment, with four longitudinal sides 14*a*, 14*b*, 14*c*, 14*d* and two end sides 14*e*, 14*f* which lie opposite one another. Here, the connector elements 14 are advantageously arranged integrally on the basic body 12, in particular with their end side 14*e*. Here, in particular, the longitudinal direction of the connector elements 14 extends substantially perpendicularly with respect to the longitudinal side of the basic body 12.

The end sides 12*e*, 12*f* of the basic body 12 in each case have a height hS and a width bS, and the end sides 14*e*, 14*f* of the connector elements 14 in each case have a height hA and a width bA (cf. FIGS. 2 and 3). The height hS of the end sides 12*e*, 12*f* of the basic body 12 is greater than the height hA of the end sides 14*e*, 14*f* of the connector elements 14. The widths bS of the end sides 12*e*, 12*f* of the basic bodies 12 are greater than the widths bA of the end sides 14*e*, 14*f* of the connector elements 14. The area of one of the end sides 14*e*, 14*f* of the basic body 12 is particularly preferably greater by a multiple than the area of one of the end sides 14*e*, 14*f* of one of the connector elements 14, preferably by a factor of at least 10. The end sides 12*e*, 12*f* and 14*e*, 14*f* are preferably of approximately square configuration. For example, the height hA and the width bA of the end sides 14*e*, 14*f* of the connector elements 14 can be in each case 2 mm, whereas the height hS and the width bB of the end sides 12*e*, 12*f* of the basic body 12 are in each case approximately 20 mm.

The basic body 12 is produced from a conductive material, for example aluminum, brass or copper, and can have a coating which comprises, for example, tin, zinc and/or nickel. The basic body 12, in particular including the connector elements 14, is, for example, milled, die-cut, injection-molded or cast, the casting process being particularly preferred.

In each case one blind opening 16*a*, 16*b* is arranged in at least one of the end sides 14*e*, 14*f* (cf. exemplary embodiment in FIGS. 21 and 22), preferably in both end sides 14*e*, 14*f*. For example, a supply cable can be introduced directly or a connector element of a supply cable can be introduced into the blind openings 16*a*, 16*b*. As will be described in more detail in the following text, the blind openings 16*a*, 16*b* also serve to connect two distribution blocks 10.

In one embodiment, starting from the longitudinal side 12*a* of the basic body 12, a through hole 18*a*, 18*b* is arranged up to the blind opening 16*a*, 16*b* which has, in particular, an internal thread, into which a clamping screw 20*a*, 20*b* can be screwed. As an alternative, instead of a clamping screw 10*a*, 20*b*, a latching mechanism for fastening an electrically conducting element, which has been introduced into the blind opening 16*a*, 16*b*, in the blind opening 16*a*, 16*b* or another fastening means can also be provided.

As shown in FIGS. 1 to 3, a longitudinal connector 30 which is configured substantially as a cylindrical element can be introduced at one end into the blind opening 16*a* (cf. FIG. 2) and can be fixed in the blind opening 16*a* by means of the clamping screw 20*a* which is screwed into the through hole 18*a* (cf. FIG. 3). In order to ensure a satisfactory contact between the clamping screw 20*a* and the longitudinal connector 30 and to prevent rotation of the longitudinal connector 30, the longitudinal connector 30 has a flat contact face 32 on its outer face, against which contact face the clamping screw 20*a* bears, a greater contact area between the longitudinal connector 30 and the clamping screw 20*a* being made possible by the flat configuration of the contact face 32.

As described using FIGS. 4 to 6, the distribution block 10 can be arranged in an insulating housing 22. The housing 22 has a bottom part 24 and a cover part 26 which surround the distribution block 10. Starting from an outer edge, the bottom part 24 can have a plurality of slots 28, in which, when the distribution block 10 is inserted into the bottom part 24, the connector elements 14 are guided and project to the outside out of the housing interior.

Furthermore, the bottom part 24 can have an opening 24*a*, 24*b* in each case in its end sides, which openings 24*a*, 24*b* are aligned with the blind openings 16*a*, 16*b* when the distribution block 10 is inserted into the bottom part 24, with the result that the blind openings 16*a*, 16*b* are still accessible even when the distribution block 10 is inserted into the housing 22. According to one embodiment, two openings 26*a*, 26*b* are likewise arranged in the cover part 26, which openings 26*a*, 26*b* are aligned with the through holes 18*a*, 18*b* when the distribution block 10 is inserted into the housing 22, with the result that the through holes 18*a*, 18*b* are accessible even when the distribution block 10 is inserted into the housing 22.

FIG. 7 shows an alternative refinement of a distribution block 10" which differs from the distribution block 10 shown in FIG. 1 merely as a result of the design of the connector elements 14'. The connector elements 14' are of cuboid configuration merely in sections, a fork-shaped element 15 which makes alternative connection types possible being arranged on the free end side of the cuboid.

FIGS. 21 and 22 show an alternative refinement of a distribution block 10'" which differs from the distribution block 10 shown in FIG. 1 merely in that in each case one blind opening 16*a*, 16*b* is not provided in both end sides 12*e*, 12*f*, but rather a blind opening 16*b* is arranged only in one end side 12*f*, whereas the other end side 12*e* is, in particular, of closed configuration.

FIGS. 8 to 11 show the connection of two distribution blocks 10, 10' by means of the longitudinal connector 30 to form a distribution block arrangement. Here, the distribution block 10' is of identical design to the distribution block 10. It goes without saying here that the alternative refinements of the distribution blocks 10" or 10'" can also be used as distribution blocks 10, 10', and any desired combinations of distribution blocks 10, 10" and 10'" can be formed.

In order to connect the two distribution blocks 10, 10' so as to be aligned with respect to one another in the longitudinal direction, the longitudinal connector 30 is pushed with its one end into the blind opening 16*a* of the end side 12*e* of the distribution block 10, whereas the other end of the longitudinal connector 30 is pushed into the blind opening 16*b* of that end side 12*f* of the distribution block 10' which faces the end side 12*e* of the distribution block 10, and the two distribution blocks 10, 10' are pushed toward one another until the end side 12*e* of the distribution block 10 bears against the end side 12*f* of the distribution block 10' (cf. FIG. 9). The longitudinal connector 30 is fixed in the distribution block 10 by means of the clamping screw 20*a* and is fixed in the distribution block 10' by means of the clamping screw 20*b* (cf. FIGS. 10 and 11). In order that both clamping screws 20*a*, 20*b* are in satisfactory contact with the longitudinal connector 30, the longitudinal connector has, spaced apart from one another in the longitudinal direction, two contact faces 32 which are configured, in particular, as flat faces. A connection of this type achieves a distribution block arrangement with two distribution blocks 10, 10' which has a greater length. In this way, as many distribution blocks 10 as desired can be connected to one another, in order to make any desired lengths of a distribution block arrangement possible.

FIGS. 12 to 15 show an alternative refinement of a distribution block arrangement with a parallel arrangement of the two distribution blocks 10, 10', the two distribution blocks 10, 10' being connected to one another by means of a transverse connector 34, as described in the following text. The distribution blocks 10, 10' are arranged in such a way that those longitudinal sides 12*d* of the basic bodies 12 of the two distribution blocks 10, 10' which lie opposite the connector elements 14 bear against one another. As a result, in each case the two blind openings 16*a*, 16*b* of the distribution blocks 10, 10' lie in one plane. The transverse connector 34 is of approximately U-shaped configuration and has two cylindrical sections 35 which are oriented with their longitudinal axis substantially parallel to one another and which can be introduced into the blind opening 16*b* of the distribution block 10 and the blind opening 16*a* of the distribution block 10' (cf. FIG. 13). The transverse connector 34 is subsequently fixed in the distribution blocks 10, 10' by means of the two clamping screws 20*a*, 20*b* (cf. FIGS. 14 and 15). Since the two distribution blocks 10, 10' bear against one another without electrical insulation, it is possible to distribute the identical current to more connector elements 14, the connector elements 14 being oriented in two different directions. In particular, greater currents can be distributed on the basis of the cross-sectional increase.

FIGS. 16 to 20 show a further exemplary embodiment of a distribution block arrangement which differs from the distribution block arrangement which is shown in FIGS. 12 to 15 merely as a result of the design of the transverse connector 34. The distribution block arrangement according to FIGS. 16 to 20 has a transverse connector 34', on which two additional connector openings 38 are arranged which are configured as blind openings which are arranged, in particular, in that face of the transversely connecting element of the transverse connector 34 which lies opposite the cylindrical sections 35. Starting from a side face of the transverse connector 34', in each case one through hole 39 is arranged as far as the connector openings 38, into which through hole 39 a clamping screw 40 can be screwed in order to fix a connector cable, which is introduced into the connector opening 38, or a further longitudinal connector 30 or transverse connector 34, 34'. Instead of the clamping screw 40, alternative fastening means can also be provided, such as a latching mechanism.

This results in a wide variety of possible combinations of two or more distribution blocks 10, 10', 10", 10'", in order to make a flexible construction of a distribution block arrangement possible.

The distribution blocks 10, 10', 10", 10'" and distribution block arrangements which are constructed from them can be used, in particular, in solar technology.

It goes without saying that it is possible to also insulate the distribution blocks 10, 10', which are oriented parallel to one another, in the same way as, for example, in the distribution block arrangement which is shown in FIGS. 12 to 15 or in the distribution block arrangement which is shown in FIGS. 16 to 20, either overall or else with respect to one another. Here, the distribution block arrangements can be arranged in each case completely in a larger housing. It is also possible to achieve insulation of the distribution blocks with respect to one another, either by arrangement of the distribution blocks 10, 10' in each case one housing 22, as described using FIG. 4 to 6, or by arrangement in a larger housing, an insulating dividing wall being arranged between the distribution blocks 10, 10'.

LIST OF DESIGNATIONS

10, 10', 10", 10'" Distribution block
12 Basic body
12*a*, 12*b*, 12*c*, 12*d* Longitudinal side
12*e*, 12*f* End side
14, 14' Connector element
14*a*, 14*b*, 14*c*, 14*d* Longitudinal side
14*e*, 14*f* End side
15 Fork-shaped element
16*a*, 16*b* Blind opening
18*a*, 18*b* Through hole
20*a*, 20*b* Clamping screw
22 Housing
24 Bottom part
24*a*, 24*b* Opening
26 Cover part
26*a*, 26*b* Opening
28 Slot
30 Longitudinal connector
32 Contact face
34, 34' Transverse connector
35 Cylindrical section
36 Bearing face
38 Connector opening
39 Through hole
40 Clamping screw
hS Height
bS Width
hA Height
bA Width

The invention claimed is:

1. A distribution block, comprising:

a basic body with four longitudinal sides and two end sides, the basic body being produced from a conductive material and a plurality of connector elements being arranged on at least one of the longitudinal sides, a blind opening being arranged in at least one of the end faces of the basic body, and there being fastening means for fastening an electrically conducting element which is introduced into the blind opening, wherein the connector elements are of cuboid configuration at least in sections with four longitudinal sides and two end sides, and both the height (hS) of the end side of the basic body being greater than the height (hA) of the end side of the connector element and the width (bS) of the end side of the basic body being greater than the width (bA) of the end side of the connector element.

2. The distribution block according to claim 1, wherein the fastening means are configured as a clamping screw which can be screwed into an internal thread which is arranged in a through hole to the blind opening, which through hole is arranged so as to start from one of the longitudinal sides of the basic body.

3. The distribution block according to claim 1, wherein the fastening means are configured as at least one latching element which is arranged in the blind opening.

4. The distribution block according to claim 1, wherein the connector elements are arranged with in each case one of the end faces of the connector elements integrally on one of the longitudinal sides of the basic body.

5. The distribution block according to claim 1, wherein the area of the end side of the basic body is greater by a factor of at least 10 than the area of the end side of one of the connector elements.

6. The distribution block according to claim 1, wherein the distribution block is arranged in an insulating housing.

7. The distribution block according to claim 6, wherein the housing is configured in two pieces with a bottom part and a cover part, slots for introducing the connector elements being arranged in the bottom part starting from an outer edge.

8. The distribution block according to claim 7, wherein openings which are aligned with the existing blind openings are arranged in the bottom part, and/or in that openings which are aligned with the existing through holes are arranged in the cover part.

9. The distribution block according to claim 1, wherein the distribution block is produced from aluminum, brass or copper.

10. The distribution block according to claim 1, wherein the distribution block has a coating which comprises tin, zinc and/or nickel.

11. The distribution block according to one claim 1, wherein the distribution block is milled, die-cut, injection-molded or cast.

12. The distribution block according to claim 1, wherein the end sides of the basic body and/or the end sides of the connector elements are approximately square.

13. The distribution block arrangement, according to claim 1, comprising two distribution blocks, being arranged either so as to be aligned with respect to one another in a longitudinal direction or so as to be parallel to one another.

14. The distribution block arrangement according to claim 13, wherein the connection of the two distribution blocks, in the case of an arrangement so as to be aligned with respect to one another in the longitudinal direction, takes place by means of a longitudinal connector which is inserted into the blind openings which are arranged in end sides which face one another, or in that the connection of the two distribution blocks, in the case of an arrangement so as to be parallel to one another, takes place by means of a U-shaped transverse connector which is inserted into the blind openings which are arranged in the end sides which lie in one plane.

15. The distribution block arrangement according to claim 14, wherein the transverse connector has at least one, preferably two, blind openings and there are fastening means for fastening an electrically conducting element which is introduced into the blind opening.

16. The distribution block arrangement according to claim 14, wherein the first and the second distribution blocks are arranged in a common insulating housing, an insulating dividing wall being arranged between the two distribution blocks.

* * * * *